United States Patent [19]

Mainka et al.

[11] 4,367,589

[45] Jan. 11, 1983

[54] DRAFTING MACHINE HEAD

[76] Inventors: Joachim Mainka, Friedrich Ebert Str., D 8080 Fürstenfeldbruck; Gerd Vogl, Zugspitzstr., D 8031 Eichenau, both of Fed. Rep. of Germany

[21] Appl. No.: 247,794

[22] Filed: Mar. 26, 1981

[51] Int. Cl.[3] ..... B43L 13/14

[52] U.S. Cl. ..... 33/1 N; 33/434; 33/438; 33/125 C

[58] Field of Search ..... 33/1 N, 1 L, 1 AA, 430, 33/434, 435, 125 C, 125 A, 438, 403

[56] References Cited

U.S. PATENT DOCUMENTS

| | | | |
|---|---|---|---|
| 4,151,649 | 5/1979 | Tatsuzawa | 33/1 N |
| 4,206,551 | 6/1980 | Matsugu et al. | 33/434 |
| 4,233,751 | 11/1980 | Koenuma et al. | 33/434 |
| 4,241,512 | 12/1980 | Chikanobu et al. | 33/438 |

*Primary Examiner*—Willis Little

*Attorney, Agent, or Firm*—Fred Philpitt

[57] ABSTRACT

A drafting machine head in accordance with this invention is provided with a rotatable drawing ruler carrier whose angular position on a graduated circle is incrementally detected by means of scanning elements and is converted into displayable angular valves by an up/-down counter, and with one or several electronic data stores, characterized in that it contains an electrically actuable locking unit (10, 11) for the rotary movement of the drawing ruler carrier (13), which unit is active in any angular position and is connected through an electronic comparator (25) to the data store or stores (23) in such a way that the valves detected on the graduated circle (12) and the valves contained in the data store (23) trigger the locking if they are in coincidence.

By this means a drafting machine head is provided which can be set to a higher degree of accuracy and is less subject to wear than is known from the prior art.

14 Claims, 3 Drawing Figures

DRAFTING MACHINE HEAD

Figure 1:
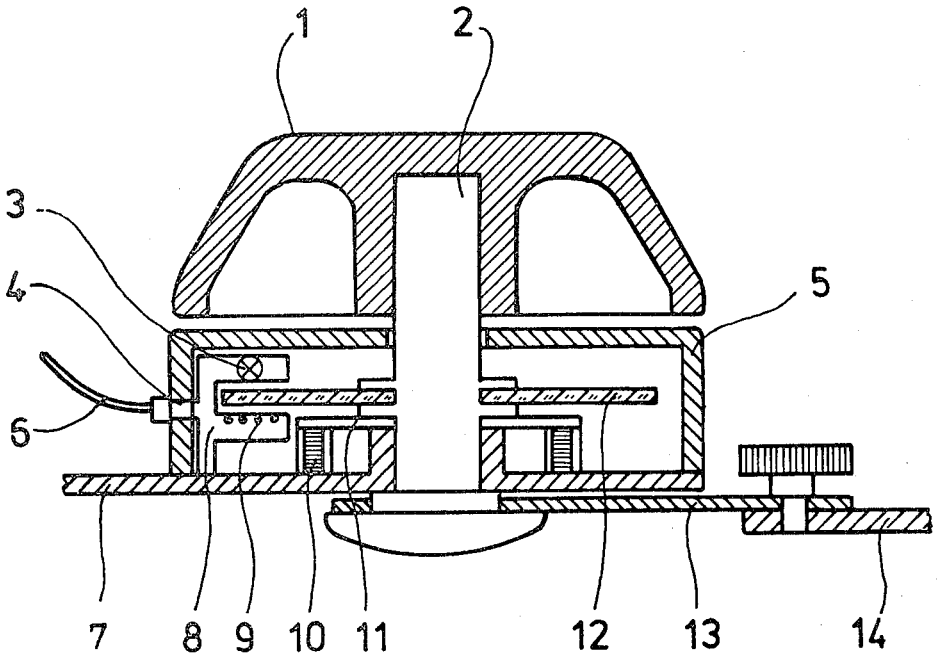

The invention relates to a drafting machine head provided with a rotatable drawing ruler carrier, whose angular position on a graduated circle is incrementally detected by means of scanning elements and is converted into displayable angular values by an up/down counter, and with one or several electronic data stores.

On drafting machine heads of this kind, the angular position of the drawing rulers is not read, as was usual in the past, from a visually observable graduated circle, —mostly a divided and engraved metal circle with index or vernier reading—, but is incrementally detected with the aid of scanning elements, for example magnetically, inductively or optoelectronically, and is further processed in such a way that the respective angular value appears in a visually detectable or else in an electronically further processable form. The advantage thereof is the digital display or reading, in other words the avoidance of any errors on the part of an individual.

Such drafting machine heads are described in German Offenlegungsschrift publications 27 52 238 and 27 12 150. As the graduated circle, there is used an original scale which is responsible for the detection of the angular position and for the reading and presentation accuracy. The graduated circle has a fine regular line division which forms angular increments which are detected and counted during the rotational movement. Up/down counting with a subsequent conversion into the customary angular units and encoding ensures a digital reading facility of the angular values in the presentation that is usual on drawing heads.

In addition to the angular reading and setting facility, drafting machine heads are usually also provided with locking units, namely (a) such which allow clamping in any desired angular position in order to be able to hold a specific, freely selectable inclination of the drawing ruler and to transfer it in parallel (e.g. for hatchings), and (b) such which act as detent facilities which allow the angular values fixed in the drawing head once and for all and frequently used in practice to be easily found.

While the locking unit of the first type is a simple clamping device operating by means of a screw or eccentric cam, that of the last-mentioned type is in the cases realized in practice a mechanical detent facility. As a rule, a springloaded stop lever engages in a disc which is serrated on the circumference at right angles or trapezoidally and which is mounted so as to be concentric with the graduated circle of the drafting machine head.

It is a disadvantage of these known drafting machine heads that the slotted disc has a circular division which is independent of the graduated circle. However, it is subjected to considerable mchanical stresses and thus also to wear, the more so since the entire rotatable part of the head is quickly rotated with the handle and the two rulers. The wear results in a deterioration of the angular accuracy, leaving out of consideration the fact that no division can be produced so as to be entirely without faults and there will therefore always be certain differences between the graduated circle and the slotted disc. The consequence thereof is that the inclined positions of the ruler fixed in the engagement are not exactly identical with the desired values or the imagined reading values on the graduated circle. There arise undesirable discrepancies, particularly when the graduated circle is read at high speed, which is possible and usual in connection with electronic scanning with a digital representation. Another very essential influence of error is to be seen in the unavoidable eccentricity between the graduated circle and the slotted disc. The eccentricity error is then sinusoidally distributed over the full circle. The two eccentricity errors, the division error of the circle, the division error of the slotted disc and the effect of wear can be added up in an extremely unfavourable manner in certain positions and can thus lead to errors which cause the basic accuracy requirements for a drafting machine head no longer to be met and this latter to be devalued in its applicability.

It is the object of the present invention to develop a drafting machine head of the kind mentioned at the beginning in such a way that it can be set with a higher degree of accuracy, which is not impaired even after a prolonged period of use, and can nevertheless be produced with a lower technical expenditure.

According to the invention, this problem is solved in that the drafting machine head contains an electrically actuatable locking unit for the rotational movement of the drawing ruler carrier, which unit is active in any desired angular position and is connected through an electronic comparator to the data store in such a way that the values detected on the graduated circle and those contained in the data store trigger the locking if they are in coincidence.

Advantageous further developments of the invention are described below.

According to the invention, the previous identity of the angle, which is present in the duality of the graduated circle/slotted disc, is eliminated in that both the angle reading and the angle setting to fixed values are based on only one scale, namely the graduated circle. This latter thus not only indicates the angular position of the drawing ruler carrier but also controls the locking unit. By way of comparison with previously input angular values, it is possible to display both all the desired angular positions and angular values of the described usual detent facilities. A single graduated circle, whose dividing and centring accuracy is responsible for all the angle-related functions of the drafting machine head, controls everything.

According to one embodiment of the present invention, angular values are non-erasably stored in at least one data store. As is known, there exist in construction and drawing engineering particularly frequently recurring angular values which in the known drafting machine designs were as a rule determined by the detent facilities. During the rotation of the head, the drawing ruler carrier jumped in at the mechanically determined values so that the rulers were fixed in the respective inclined position. In the present invention, these detent facilities are replaced by fixedly programmed values. As hitherto, it is up to the manufacturer what values he wants to program non-erasably in accordance with the field of application.

According to another embodiment, all the angular values which have been offset by the difference of 15°, starting with 0°0′0″, are non-erasably stored in a data store. Previously determined angles spaced at 15° meet a practical requirement that arises particularly frequently. For example, the known angles of 30°, 45° and 90° are also covered thereby, and so is the angle of 60° which occurs, for example, on threads.

In order to ensure that, over and above this, virtually any angle and any angle combination can be input and is thus always easily and reliably available to the user of the drafting machine, the invention makes provision for there to be provided on the drafting machine head an input mechanism for programming any desired angular values in a freely selectable sequence of action into the electronic data store or stores. Suitable input mechanisms are available as standard constructional units. They must correspond to the data store in the linking data and can then simply be inserted in the head of the drafting machine. With their aid, one can input any desired values, namely in such a way that the input sequence corresponds to the output sequence with repeated fetching. In principle, the invention is not confined to a single electronic data store, but several of such stores may be used. For example, it is possible to input different angle programs into different stores. This gives the user the great advantage of being able to completely pre-program with respect to the consecutive angles a complicated drawing task, for example during the production of maps, the construction of complicated technical structures with very numerous, constantly recurring elements, the construction of curves or in connection with graphic tasks. The drawing process is then largely automated and proceeds rapidly and without errors. Setting the same angles by hand again and again would lead to fatigue phenomena and consequently also to human errors.

In the development described in another enmbodiment, the user can cancel the input angular values at any time. Corrections are also easily possible by this means.

A further refinement of the above thoughts is set forth in the invention, which states that the values in the data stores can be optionally fed to the comparator. In other words, the user shall not be forced to recall an input program constrainedly in the programmed form but has the possibility of inputting, that is to say putting circuitwise into contact with the comparator, one angular value or an angular value sequence, while he can disable another angular value or another group of angular values, so that they do not come into action during the execution of the program.

A substantial work simplification is achieved in that the insertion of the values programmed in the data store is brought about in the indicated sequence by the release of the locking unit. The user thus does not have at each new step to call the due angular value by, for example, key pressure, but this process is automatically brought about in that the user releases the locking unit. The release of the locking unit has thus been combined in one functional unit with the enabling of the next angular value.

Since it frequently happens in modern engineering that the angular values to be transferred into a drawing originate from a complicated computing operation and are thus output by a computer, the invention makes provision for there to be provided a connecting element, with the aid of which values from a computer can be input into the data store. With the aid of this connecting element, which may be constructed of conventional electronic components and whose construction does not cause any difficulties, the user can thus take at any time angular values from a computer directly into the drafting machine head. This is important, above all in those cases where a co-ordinatograph or a large automatic drawing system is not available. The reverse application possibility is also conceivable, namely that angular values are taken from the drawing and, with the aid of the mentioned connecting element, are input into the computer, which provides, for example, the program control for a machine tool. The locking unit mentioned previously is defined more precisely hereafter. It comprises an electro-magnetically actuated braking device which acts on a uniform disc which is fixedly connected to the shaft. A particularly advantageous constructional form of the locking unit is set forth herein, namely the known 'per se' electromagnetic braking device. The disc has to be uniform so as to ensure that braking can become effective in the same manner in any angular position. It is possible to design electromagnetic braking devices with very economical and operationally reliable means in such a way that they act extremely rapidly and very forcefully. Electromagnetic braking devices of this kind are at least as reliable as the hitherto used detenting and clamping devices. But they present the advantage that wear does not in any way impair the angular accuracy or the efficiency.

As an extension of the afore-mentioned apparatus, the invention makes provision for a device for releasing the locking unit. As has been stated above, the stepping-on of the angular value is simultaneously bound up with this device.

The manipulation of the machine is considerably facilitated in that, when the locking unit is activated, a perceptible signal is triggered. By this means, the user is always sure that the ruler is locked or that the machine operates in the desired manner. Depending on the preferred construction, it may be a sound or light signal or possibly a combination of both signals.

Electromechanical braking devices, such as are mentioned previously, have the characteristic that the magnetic field causing the braking force requires a certain time until it reaches its full intensity. Unless it is considered by a corresponding measure, this time difference might lead to a delay in the locking process. The consequence would then be that, when the pre-programmed angular value at which the locking is to take place is reached, the rotary movement of the drafting machine head continues to a slight degree until the full braking force causes it to stop.

For this reason, the following measure is taken. The measure provides for independent pre-braking which is adapted to the rotary speed. This pre-braking has the effect that, as the locking braking operation starts, there is only a considerably reduced angular speed still present, at which the moment of inertia of the rotated body no longer has any noticeable effect.

There comes about a reliable stoppage on the stored angular value, the accuracy of which is better than or equivalent to that of the digital angular display.

The invention further provides for a particularly economical constructional form of the computer-controlled locking and braking unit, the braking pattern being determined by several consecutive braking pulses which are derived from the increments of the graduated circle. The arithmetic unit can be constructed in a particularly simple manner, it suffices that, while considering the sense of rotation, it detects a fixedly input angular distance from the stored locking angle and, as has already been described, emits a pulse which sets the braking device in motion.

In accordance with the as a rule fine division of the graduated circle, the individual braking pulses follow one another so closely that the user does not notice them as separate impacts but notices them as an even deceleration.

After reaching the locking angle, the locking unit is set to a reduced braking force by a timer. The importance of this additional circuit lies in its economy. For the timer ensures a minimum power consumption of the electromagnetic locking unit. As mentioned above, a stepped braking operation is followed by the actual locking. This locking has to act rapidly and must be absolutely reliable. For this purpose, it is necessary to reach a very high braking force by a correspondingly strong electromagnetic field. Even if the rotary movement of the drafting machine head has already been reduced to a very large degree by the computer-controlled gradual braking sequence when the locking position is reached, a powerful additional braking operation has nevertheless to ensure reliable locking, particularly if the moving hand involuntarily still exerts a certain torque on the drafting machine head.

Once complete braking to a standstill has been effected, that is to say following locking, it suffices to compensate for the unilateral weight loading by the drawing rulers and the contact pressure of the drafting apparatus. In this state, a considerably lower locking force is sufficient in order to prevent any displacement. For this reason, the electromagnetically acting braking force is reduced. In this connection, a lesser current flows through the magnet coil, which means a lower power consumption.

Figure 2:
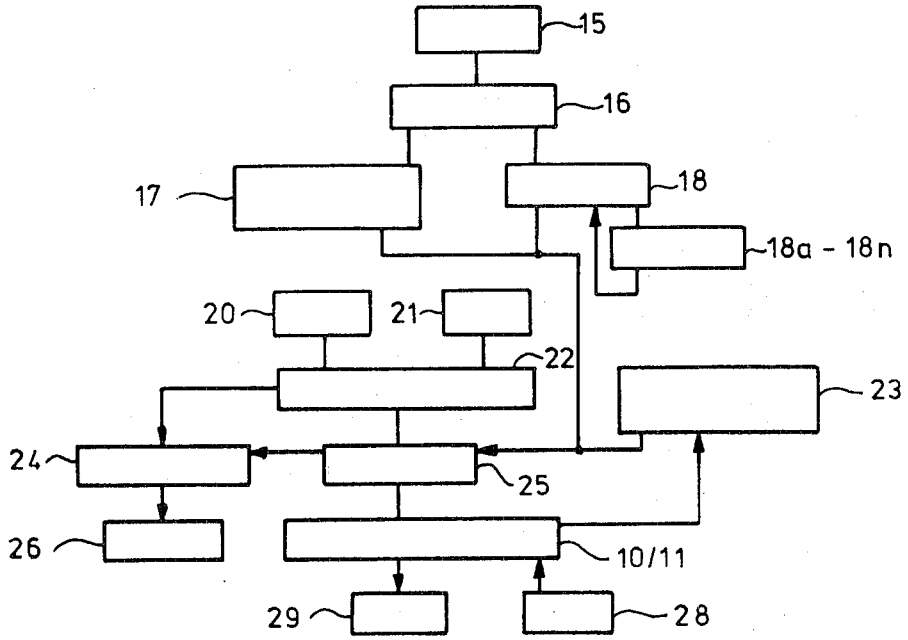
Figure 3:
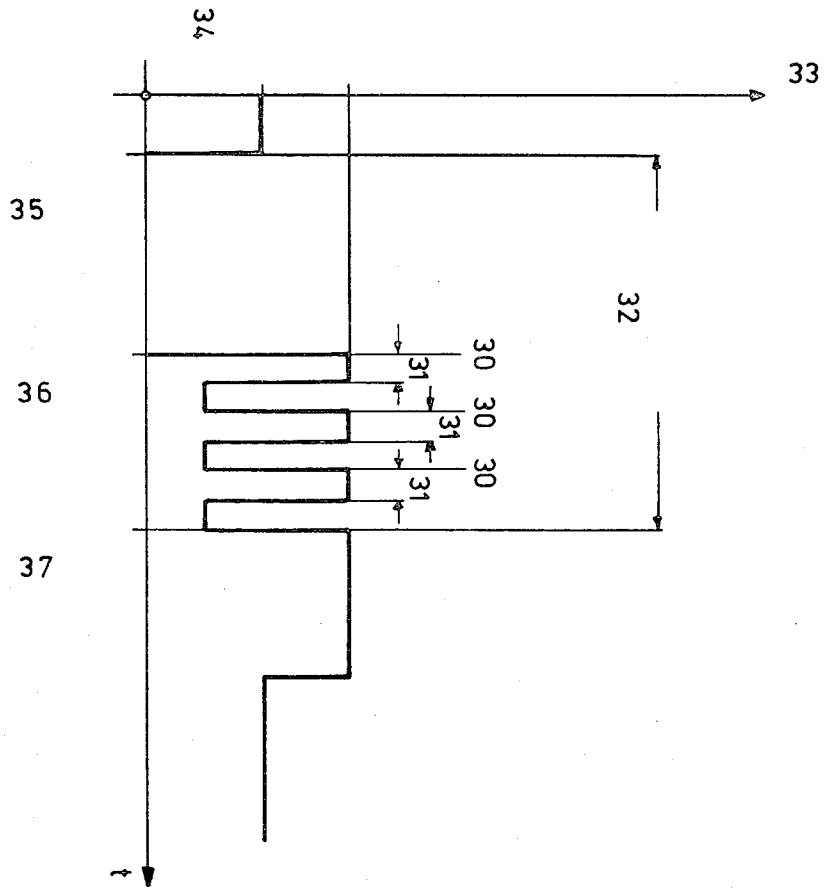

Some exemplified embodiments of the invention will be explained in more detail hereinafter with reference to the drawings, in which FIG. 1 shows a section through a drafting machine head according to the invention;

FIG. 2 shows a block diagram of the various electronic components;

FIG. 3 diagrammatically shows the braking force as a function of time in a particularly preferred drafting machine head according to the invention.

In FIG. 1, the essential elements of a drafting machine head are discernible. The drawing rulers 14 are secured to the drawing ruler carrier 13. The drawer ruler carrier 13 has a shaft 2, on which the graduated circle 12, which indicates the angular position, and a handle 1 for manual rotation are secured. The graduated circle 12 has a fine uniform line division which is not shown in the figure and whose intervals correspond as a rule to the finest angle reading value required. The division is in general scanned by electronically working scanning elements (sensors). However, fine mechanical detent sensing or electrical brush sensing is also conceivable. Likewise, magnetic or electroinductive scanning is feasible. In the exemplified embodiment diagrammatically shown herein, the graduated circle 12 is transparent in design and is scanned by opto-electric components. In the example shown, these are secured to a U-shaped support 8. On one side, there is secured a light source 3, for example a small bulb or a luminescence diode. On the other side, there is situated a scanning diaphragm comprising a fast acting opto-electronic sensor 9, for example a photoconductive cell, a photodiode or a phototransistor. As the graduated circle 12 rotates, there emanate therefrom electric pulses which can be further processed electronically.

This further processing is diagrammatically shown in FIG. 2. The sensor 9 passes the pulses on to an up/down counter 22 which simultaneously converts the counting values thus obtained, and which respectively indicate the distance from a zero position at which the counting process started, into the usual angular values and encodes them in this form, for example with the aid of the BCD code. The components described herein correspond to the prior art.

Over and above this, there is installed in the drafting machine head an electronic data store 23, into which fixed and variable values can be input. Of course, programming is effected in the same notation in which the values output by the counter 22 are notated. Over and above this, it is possible to input by hand additional freely selected values with the aid of a suitable data input unit 17.

An electronic comparator 25 is connected to the data store 23. The angular values which have been detected on the graduated circle 12 and have been converted are continuously input thereinto in a form that is compatible with the data store 23. Electronic comparators are generally known. In the present case, it is the function of the comparator 25 continuously to compare the angular value coming from the counter 22 with the angular values of the data store 23. If both values are identical, then the comparator 25 triggers a pulse and passes it to a locking unit 10, 11. This unit causes the locking to occur, which on the conventional drafting machine heads is brought about either by a clamping screw operated by hand or by a detent facility.

Thus, if the drawing ruler carrier 13 is rotated, then the comparator 25 establishes the identity of each angular value fixedly or freely programmed into the data store 23 and then immediately activates the locking unit 10, 11. Only when the locking unit 10, 11 is inactivated, in other words released, can the drawing ruler carrier 13 be rotated further.

There is thus required only a single exact angle scale, namely that of the graduated circle 12. For the locking unit 10, 11, there is only needed a simple undivided metal disc 11 which is not provided with slots. The graduated circle 12 with the scanning unit 3, 9 is in any event a basic component that is necessary on each drafting machine head. The electronic components which are additionally required, namely the data store 23 and the comparator 25, can be realized by standard cheap integrated modules. These are easily obtainable and exchangeable, do not require any maintenance, are not subjected to any wear and, over and above this, their space and weight requirements are much smaller. The complicated, highly accurate detent facility, which is subjected to wear and consists of a stop lever, a spring, pin joints and the associated manual operating elements, is dispensed with.

The above described simplest type of automatic locking control (triggering of the locking pulse when a programmed angular value is reached) can have the disadvantage that, on account of the inertia of the mechanical moved parts and the time required for setting up the magnetic braking field, the drafting machine head shoots beyond the desired position. For this reason, it may be expedient to effect an independent preliminary control of the braking operation, which starts before the programmed angular value is reached and will be described hereinafter with reference to FIGS. 2 and 3.

Integrated in the data store 23 is an electronic computer which determines the dynamically required braking sequence from the sense of rotation and the angular speed of the drawing ruler carrier 13 and the stored locking angle and which, for the implementation thereof, activates the electromagnetic braking device 10 and controls it until the locking angle is reached.

This computer receives from the up/down counter 22 the angular values which are incrementally detected on the graduated circle 12 by the sensor 9 and determines by addition or subtraction (depending on the sense of rotation) an angular value which, in the movement sequence, precedes in time the angular value input into the electronic data store 23. The difference can either be input into the computer as a fixed value, namely if the braking sequence is variable and is adapted to the angular speed, or it can be derived from the angular speed registered by the computer. It is furthermore the function of the computer to trigger a pulse when the mentiond angular distance from the stored locking angle has been reached. This pulse acts on the electromagnetic braking device 10 and puts it into action with a suitably stepped braking force. The computer can control both the braking force and the braking path in accordance with the angular speed. The computer stays in action until the stored locking angle is reached. Then the final locking brake operation starts.

Expediently, there are used for stepping the braking force pulses which are derived from the increments of the graduated circle 12. These pulses are processed in the following manner (see FIG. 3):

The pulses 30, which flow into the counter and originate from the increments of the graduated circle 12, are gated through a logical circuit with the (permanent) computer pulse, which starts at the above mentioned specific distance prior to the stored locking angle. If both signals are applied to the input of the logical circuit, the electromagnetic braking device 10 is triggered through a timing element (not shown) and the braking operation is maintained until the time 31 set in the timing element has expired. This process is diagrammatically shown in FIG. 3. Therein, there is plotted on the abscissa the time t which is directly associated with the angle of rotation during the rotation of the drafting machine head. The braking force 33 is plotted on the ordinate. As can be seen in the representation, in this preferred exemplified embodiment, there is not used a continuously stepped braking force but the stepped action is brought about in that individual braking pulses are given in succession. Each of these pulses reaches the maximum braking force. The braking start 36, that is to say the start of the first braking pulse, emerges from the drawing. Furthermore recorded is the point in time of the locking braking 37. This braking operation is associated with the angle of rotation 32 from the starting position or from the release of the preceding locking to the renewed locking. This angle of rotation is subdivided into a free movement and the braking movement.

Following the termination of the first or any braking pulse 31, the drawing ruler carrier 13 can be rotated further until the braking device comes once more into action, caused by the pulse originating from the next graduated circle increment. This process is periodically repeated until the stored locking angle 37 has been reached. In this position, a pulse from the comparator 25 causes the final locking to occur. The sequence of individual braking pulses is not resolved in practice since the triggering divisions of the graduated circle 12 follow one another very closely. Individually, a uniform deceleration is felt.

As can also be discerned from FIG. 3, the braking is reduced to some extent when, following the beginning of the locking braking operation, a certain time has elapsed. This is ensured by a timer (not shown) which is also triggered by the sensor 9 in combination with the data store 23. It acts in such a way that when the angular value identity is reached, there is enabled a timing element which, upon the expiration of the fixedly input time, reduces the current flowing through the magnet coil to a previously determined fraction.

The described drafting machine head—with or without a preliminary braking facility—allows an extremely advantageous simple mode of operation (see FIG. 2):

The user switches the apparatus on (15) and with the aid of the selector switch 16 selects in the range of the fixed values (18), for example, the 15° step (18*a*). The value 000.00 appears on the display unit 26. If the user now takes hold of the knob 1 in order to bring about an angular displacement of the drawing rulers 14 from the normal drawing position, he cancels the locking by actuating the "release" (28) key.

The drawing rulers 14 are now freely movable around the shaft 2 until the angular value of 1 5.00° is reached. At this value, which has been pre-selected by the user, the drawing rulers 14 are fixed, being controlled by the comparator 25, the locking unit 10, 11 and possibly the computer controlling the preliminary braking. Since, due to the use of conventional drafting machines, the user is accustomed to hearing a clearly perceptible mechanical noise during the detenting operation, the drafting machine head is connected to a sound signal device or the like, which emits a short sound after the locking unit has come into action.

The described process can be repeated as often as desired by the renewed actuation of the "release" (28) key.

If the user of the drafting machine head requires a different angular value which has not been fixedly preprogrammed, he selects through the selector switch 16 the "manual data input" (17) and inserts the desired angular value into the data store or stores 23 as the angular value to be detented. The sequence of the release of the programmed data stores 23 is selectable by the user of the actuation of a key not shown in FIG. 2.

We claim:

1. A drafting machine head, comprising:

a housing a drawing ruler carrier, a shaft rotatably mounted in said housing and having said ruler carrier and graduated disc attached thereto, scanning elements mounted in said housing and associated with said graduated disc, an up/down counter electrically associated with said sensor, one or more electronic data stores, the angular position of said rotatable drawing ruler carrier on said graduated disc being incrementally detected by means of said scanning elements and being converted into displayable angular values by said up/down counter; and an electrically actuatable locking unit for restricting the rotary movement of said drawing ruler carrier, said unit being active in any angular position, an electronic comparator electrically connected to said unit and said one or more electronic data stores in such a way that the angular values detected on the graduated disc and the angular values contained in said data store trigger the locking if they are in coincidence.

2. A drafting machine head as claimed in claim 1 characterized in that angular values contained in said data stores are non-erasably store in at least one data store.

3. A drafting machine head as claimed in claim 2, characterized in that all angular values which have been offset by the differences of 15°, starting with 0°0′0″, are non-erasably stored in an electronic data store (23).

4. A drafting machine head as claimed in claim 1, characterized in that there is provided on the head an input mechanism (17) for programming any desired angular values in a freely selectable sequence of action into the electronic data store or stores (23).

5. A drafting machine head as claimed in claim 4, characterized in that there is provided a cancel key for cancelling the angular values input in the electronic data store.

6. A drafting machine head as claimed in claim 1, characterized in that the values in the data store or stores (23) can be selectively fed to the comparator (25).

7. A drafting machine head as claimed in claim 6, characterized in that the insertion of the values programmed in the data store or stores (23) is brought about in the sequence in which they were input by the release of the locking unit (10, 11).

8. A drafting machine head as claimed in claim 1, characterized in that there is provided a connecting element, with the aid of which values from a computer can be input into the data store (23).

9. A drafting machine head as claimed in claim 1, characterized in that the locking unit (10, 11) comprises an electromagnetically actuated braking device (10) which acts on a uniform disc (11) which is fixedly connected to the shaft (2).

10. A drafting machine head as claimed in claim 1, characterized in that there is provided a device (28) for releasing the locking unit (10, 11).

11. A drafting machine head as claimed in claim 1, characterized in that a perceptible signal (29) is triggered when the locking unit (10, 11) is activated.

12. A drafting machine head as claimed in claim 9, characterized in that there is provided a computer which determines, from the sense of rotation and the angular speed of the drawing ruler carrier (13) and the stored locking angle, the dynamically required braking sequence and for the realization thereof activates the locking unit (10, 11) and controls it until the locking angle is reached.

13. A drafting machine head as claimed in claim 12, characterized in that the braking sequence is determined by several consecutive braking pulses which are derived from the increments of the graduated disc (12).

14. A drafting machine head as claimed in claim 1, characterized in that there is provided a timer which sets the locking unit (10, 11) to a reduced braking force after the locking angle has been reached.

* * * * *